US007494127B2

(12) United States Patent
Schmidt

(10) Patent No.: US 7,494,127 B2
(45) Date of Patent: Feb. 24, 2009

(54) STORY TELLING GAME AND APPARATUS

(76) Inventor: Brenda Marik Schmidt, 123 Gold Meadow Dr., Cary, NC (US) 27513

( * ) Notice: Subject to any disclaimer, the term of this patent is extended or adjusted under 35 U.S.C. 154(b) by 80 days.

(21) Appl. No.: 11/470,617

(22) Filed: Sep. 6, 2006

(65) Prior Publication Data

US 2008/0054566 A1 Mar. 6, 2008

(51) Int. Cl.
*A63F 1/02* (2006.01)

(52) U.S. Cl. ..... 273/299; 434/167

(58) Field of Classification Search ..... 273/308, 273/440, 429–432, 272, 299; 434/129, 156, 434/167, 322, 324
See application file for complete search history.

(56) References Cited

U.S. PATENT DOCUMENTS 1,379,871 A * 5/1921 McGuire, Jr. ..... 273/292
1,716,069 A * 6/1929 Loayza ..... 273/141 R
3,891,209 A 6/1975 Kritzberg
4,637,799 A * 1/1987 Bouchal ..... 434/236
4,684,135 A * 8/1987 Bouchal ..... 273/269
4,966,372 A 10/1990 Robison
5,100,154 A * 3/1992 Mullins ..... 273/429
5,547,199 A * 8/1996 Calhoun ..... 273/299
5,657,992 A * 8/1997 Bellizzi ..... 273/273
6,638,171 B1 10/2003 Igarashi et al.
2005/0167920 A1* 8/2005 Rose et al. ..... 273/292
2006/0040748 A1 2/2006 Barthold
2007/0007725 A1* 1/2007 Matilla et al. ..... 273/236
2008/0012229 A1* 1/2008 Rose et al. ..... 273/296

* cited by examiner

*Primary Examiner*—William M Pierce
(74) *Attorney, Agent, or Firm*—Jim Passé; Passé Intellectual Property, LLC

(57) ABSTRACT

The present invention relates to a game for stimulating imagination and creativity in a plurality of players by story telling. The game involves each player which can be an individual or team of players selecting a given number of photo cards depicting a discrete scene place or object and using one or more of the selected cards to tell a story. A score is developed based on pre-determined characteristics including composition of the story; having a beginning, middle and end; as well as time to tell the story. The winner of the game is determined by the player with the highest score.

13 Claims, 4 Drawing Sheets

8

8

WHAT'S THE STORY-SCORECARD

PLAYER #1 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

PLAYER #2 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

PLAYER #3 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

PLAYER #4 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

PLAYER #5 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

PLAYER #6 _____

| ROUND | 1 | 2 | 3 | 4 | 5 | 6 | 7 |
|---|---|---|---|---|---|---|---|
| CREATIVITY | | | | | | | |
| INTEREST | | | | | | | |
| TIME | | | | | | | |
| STORY-TELLING | | | | | | | |
| SUBTOTAL | | | | | | | |
| TOTAL | | | | | | | |

FIG. 3

STORY TELLING GAME AND APPARATUS

BACKGROUND OF THE INVENTION

1. Field of the Invention

The present invention relates generally to story telling games and apparatus and devices useful for playing the games. More specifically, the invention relates to a game and game apparatus for stimulating imagination and creativity in a plurality of players or teams of players by story telling.

2. Description of the Related Art

The use of an image to stimulate ideas, creativity and story telling, as well as verbal skills is known. For example, in U.S. Pat. No. 1,379,871 issued May 31, 1921 to McGuire, depicts a set of cards where each card depicts a scene and object or descriptive matter to be used as a game or puzzle. The object of the game is to arrange all the cards in the proper order to tell a story. No story is actually told by any players, rather, the story is known ahead of time and the game play is accomplished by players equally distributing all the cards and then, on each successive turn, arranging cards based on the known story.

In U.S. Pat. No. 3,891,209 issued Jun. 24, 1975 to Kritzberg, a game is disclosed that comprises sets of cards wherein each card is provided with a series of related words. A card is randomly selected by a player on their turn and the player must make up a story about or using one of the words on the card. The player receives two gold stars for completing a story and the winner of the game is the player with the most gold stars. In this game, however, no graphic or pictorial images are used and no grading, score or criteria are used in telling the story.

A branching storyline game has frequently been described, for example, in US Patent application No. 2006/0040748 published Feb. 23, 2006 by Barthold. Here, a storytelling game is disclosed where the goal of the game is to work through a story to a successful ending by choosing among possible story directions at story branch points. The game can include electronic card readers and multiple story cards. While cards and a story are involved there are no photo cards or story telling by the players and the game involves one story where multiple players are involved in the one story.

A story telling game involving pictures is described in U.S. Pat. No. 4,684,135 issued Aug. 4, 1987 to Bouchal. In this game, each player is provided with a game card which is imprinted with pictorial illustrations and legends characterizing a predetermined number of different kinds of stories, which each player is to tell during the course of play. The players determine, randomly, the characteristics of the story to be told and win by completing stories using the entire card.

The previous games though do not provide for constructing stories where the story has specific beginning, middle and end nor where the story is scored based on the quality of the story. Further, there are no games which utilized photo cards and where the story is based totally on the players' creativity in interpreting the content of the photo.

SUMMARY OF THE INVENTION

It is an object of this invention to provide both game equipment and a game that stimulates imagination and creativity by story telling. It is a further object of this invention to allow the maximum amount of creativity in a story telling game by providing a game that does not restrict the boundaries of the story other than by a photo of a scene, place or object. It is also an object of this invention to stimulate creativity while requiring that any story told have a beginning, middle and end so as to aid in the development of story telling skills that include telling a complete story rather than a story which is only partially complete. It is also an object of the invention to provide a game that improves story telling skills.

It is a further object of the invention to further provide a game which educates players on the structure of a good story by requiring a beginning, middle and end to a story. It is yet another object to provide a story telling game which requires the story telling of a player to be judged for quality content and the like by another player or third party in order to improve the players' ability to tell a story that will be judged positively by another person.

It is an aspect of the invention to provide a story telling game with photo cards that can have either related topics or can be used with unrelated topics. It is another aspect of the invention to provide a means for determining the primary characteristics of a story with only a photo or series of photos to determine the content of the story.

In one aspect, the invention relates to a game apparatus for stimulating imagination and creativity in a plurality of players comprising:

a. at least 3 photo cards per player, wherein each of said photo cards depicts a different, discrete scene, place or object;
b. a timing means for timing a player telling a story having a beginning, middle and end and incorporating the scene, place or object from at least 1 photo cards in each story; and
c. a means for scoring a players story telling.

In yet another aspect of the invention there is a method for playing a game which stimulates imagination and creativity by story telling comprising:

a. having a minimum of 2 players who compete in the game by telling a story;
b. each player selecting at least one photo cards from a collection of photo cards, the collection having at least 3 photo cards per player, wherein each photo card depicts a scene, place or object;
c. each player, in turn, telling a story that includes information depicted in at least one of the photo cards selected by the player;
d. removing a photo card from the game after it has been used in telling a story;
e. using a predetermined method to determine if each told story has a beginning, middle and end;
f. penalizing any player who has been determined to have told a story that does not contain each of a beginning, middle and end;
g. determining a score for the told story; and
h. determining a winner of the game by selecting the player who has the highest total score.

BRIEF DESCRIPTION OF THE DRAWINGS

FIG. 3 is a view of an embodiment of a multiplayer score card

DETAILED DESCRIPTION OF THE INVENTION

Figure 1:
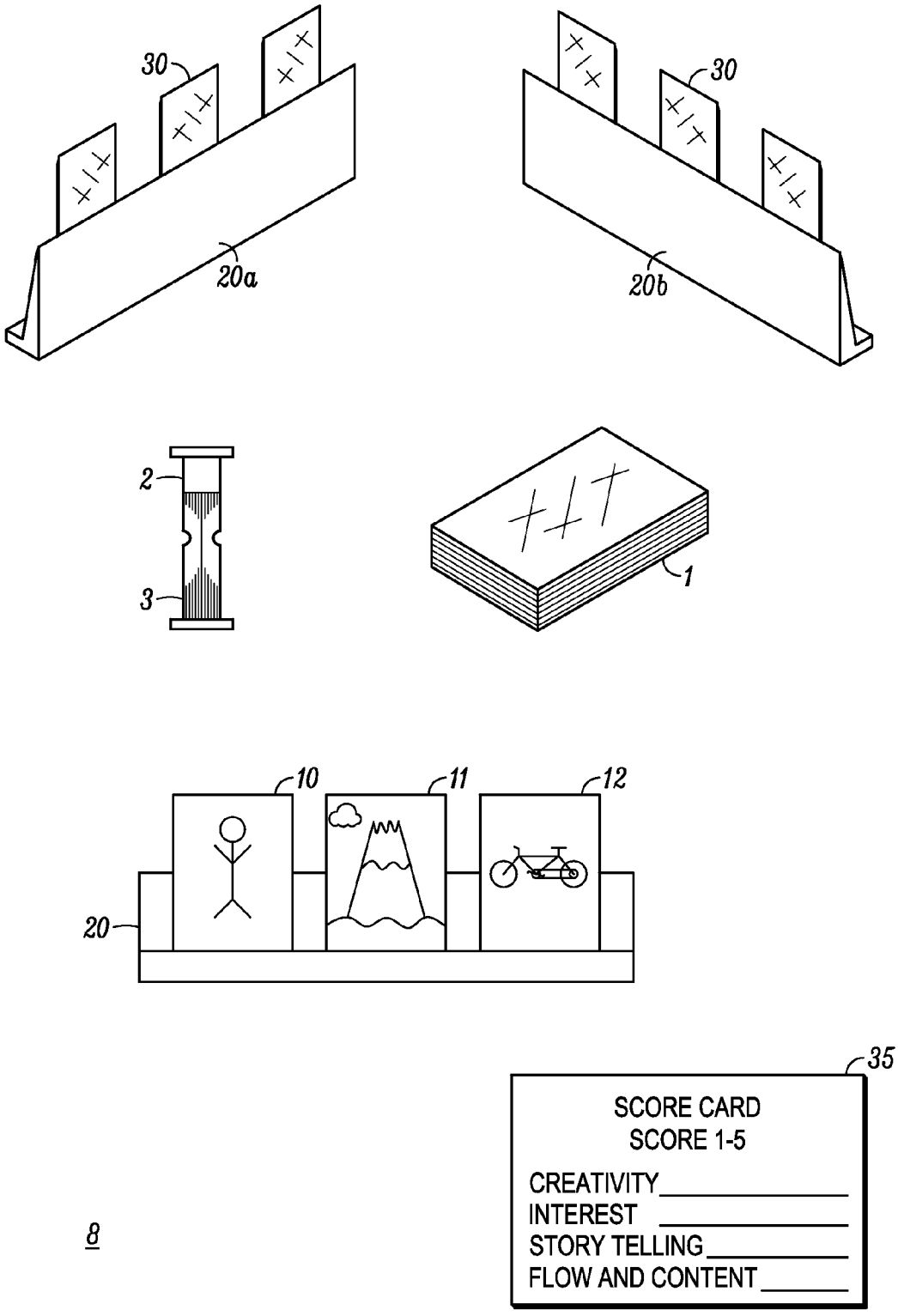
FIG. 1 is a view showing, in perspective, a view of the game apparatus pieces of one embodiment of the invention.

The present invention relates to a game for stimulating imagination and creativity by means of story telling. The game apparatus of the invention includes a series of photo cards. As used herein "photo card" refers to a card for, example, a playing card size, that has an individual photograph of a discrete scene, place or object on one side of the card. There is a plurality of photo cards in the game apparatus, there being at least 3 photo cards for each player in the game. Each photo is a discrete different photo in the set of photo cards. The number of total cards depends on the number of players in the game as well as the number of rounds to be played in the game as well as the number of photo cards taken in each round. So, for example, if there were 4 players taking 3 cards per round and there were 3 rounds, there would need to be at least 36 photo cards. If there were 4 rounds there would need to be at least 48 photo cards. The content of the photographs in a set of photo cards can be totally unrelated where each photograph has nothing to do with the other photos. In another embodiment, there could be a general theme to the photo cards even though each card is a different photograph. So where they are themed, the photos could, in one embodiment, be photos of family scenes. In another embodiment, the photo cards could all be themed around a sport, location, activity or the like. It is an embodiment of the invention that the photo cards do not represent a particular story such that selection of multiple cards would suggest a known story. So for example, photos from a well known movie that suggest the plot of the movie would not be contemplated within the scope of the invention.

While each photo card is different, it is in another embodiment of the invention that the photos present interesting subjects with as much detail as possible for a player to draw upon when story telling. However, since the photo will be of a real life actual scene, place or object, realism will be preserved in the photos and players will have the challenge of story telling around reality.

The game apparatus also comprises a timing means. As used herein, "timing means" means a device for timing the telling of the story. That is, when a story is told, the player only has a limited time to tell the story. Also, a period of time is given to study the cards and think of a story. Since the time to do these things can be different, for example, 15 seconds to prepare to tell the story and one minute to tell the story, the apparatus can include a timer capable of timing different intervals. One embodiment of the invention the timing means is a sand timer. In a second embodiment there are 2 timers. Other timing means such as stop watches, digital timers and the like are also embodiments of the invention.

The game apparatus also optionally includes a means for determining if a story has a beginning, middle and an end. The means for determining the game having a beginning, middle or end in one aspect is either one or more of the other players in the game or a third party not playing the game. It could also be a set of criteria on a score card. The criteria can be predetermined in the game or decided on by the players, or the like. So, for example, if 3 photo cards are selected, each card can represent the beginning, middle or end. In an aspect of the invention at least one photo card aspect must exist somewhere in the beginning middle or end. In another aspect of the invention, the criteria can be more detailed with the beginning needing to introduce the story, the middle being the body of the story and the end being a moral or some aspect that ties the aspects of the story together.

The game apparatus also includes a means for scoring a players or a team of players for the story being told. For example, characteristics like creativity, interest, story telling skills of the story teller, the time to tell a story, and flow and content could all be measured. More or less characteristics could be measured as well. One means for scoring the characteristics could be a score card with provisions for scoring, say for example on a one to five scale for each of the desired characteristics of the story. Another means of scoring the game can be adding up the number of photo cards used by each player in telling stories. Yet another method involves combining the score for characteristics of the story with the score for the total number of photo cards used to achieve a total score.

The invention also relates to a method of playing a game using the apparatus. The game is designed to be played by at least two players. A "player", as used herein, can consist of a single person or it can consist of a team of players of any reasonable number. As many people as desired can play the game, only limited by the number of photo cards and the complexity of a large number of people, including the time to play a round. In one embodiment, the number of players is between 2 and about 8 players. Where there is a team of players, each member of the team would be responsible for telling a part of the story. In one embodiment, each team has 3 players and each team player is responsible respectively for telling the beginning, middle and end of the story.

The game begins by the game players selecting a series of photo cards, for example 3 photo cards. This can be done at the beginning of each turn, the beginning of the round by all players or the like. Any method is used to decide which player begins play and then what order each player takes their turn comprising a round. The photo cards as described above are hand held, placed in a holder, stand or the like and then in turn, the player studies one or more of the cards. The act of preparing to tell a story can be time limited and could be included in a score. A timer is started to begin story telling and then the player or team has the selected time to tell a story with a beginning, middle and end. The player tells the story using at least in part, information in at least one of the selected photos or from more than one photo on the multiple cards selected. In one embodiment, the player must use a separate photo card to tell each of the beginning, middle and end of the story. In another embodiment, the player must use all cards selected each round to tell a story. In another embodiment, the player uses as many cards as he can to tell a story but is not penalized for not using all the photo cards he has selected. As used herein "information depicted in at least one of the photo cards" means to use any information desired by the player contained in the photo as part of the story or a basis for the story. For example, if one card has a picture of a bicycle, the player could tell a story about a bike race, a bike ride or tell a story about the specific bike in the picture. The player could also talk about other information in the photo and ignore the bicycle entirely.

Once the story has been told by a player, any photo cards used in the telling of the story are discarded into a pile, normally to be used in other games but removed from play in the particular game being played.

At some point in the round, usually right after the story is told, one or more players or teams or an independent third party determine if the story told contains a beginning, a middle and an end. This can be a subjective determination or can purely objective in nature. The players themselves can determine the criteria, for example by voting, or there can be a predetermined set of criteria to make the decision. If there is not a beginning, middle or end of the story, then this situation can be treated a number of ways. Either the story automatically receives no points for that story or that round of story telling or in another embodiment the player is eliminated from further play.

During the determination of the existence of a beginning, middle or end, one particular embodiment of such determination is after a player has completed their story, any other player may challenge the story, for example, by stating "What's the Story?" The remaining players and the challenging players can then vote if the story is complete with a beginning, middle and end or not. If it is determined the story is not complete, the player either gets no points or score for that round or in another embodiment the player is eliminated from play. In another embodiment if the vote to determine if there is a beginning, middle and end determines there is all three then the challenging player receives a penalty for example by loosing a predetermined amount of points in their score.

If a story has been determined to have a beginning, middle and an end the next step in one embodiment in the game is to determine one or more characteristics for the story and to assign a score to those characteristics. As discussed above, each characteristic is scored, for example, on a 1 to 5 point scale. The total characteristic point score at the end can be one of the criteria for determining the winner of the game. In one embodiment of the game, the same characteristics are used for each story told for each player and during each round. In another embodiment, the characteristics scored changes, so for example, each round would measure a different characteristic of story telling.

As discussed, the play can continue through multiple rounds. Players tell a new story each round and multiple scores are awarded wherein a highest characteristic score is determined by totaling the score on each round. In one embodiment the players play seven rounds and select 3 cards during the first two rounds and increase the number of cards selected by one each round.

The number of cards taken can be varied as play continues or can remain constant. For example, the number of cards taken each round by a player increases by one every selected round of play. In another embodiment of the game, the same number of photo cards is taken each time.

As previously discussed, the play can be one or more rounds of story telling. The more rounds the more stories and photo cards used and as such the higher the scores measured. The end of the game can be determined by either the total score received on one or more rounds, by the total number of photos used to tell a story or both.

Now referring to the drawings, FIG. 1 is a depiction of typical game apparatus for playing the game of the invention. A pack of face down photo cards 1 sits in the middle of the playing area 8. Next to photo card pack 1 is sand timer 2 depicted during timing having sand timer sand 3 draining to time an event. Also shown are three individual face up photo cards 10, 11 and 12 facing the viewer (player) and each photo card depicting a different photo (represented in the figures as a drawing). Each of the photos has been placed in an optional stand 20 for ease in viewing the cards by the player while preparing the story. Also shown in each of stands 20*a* and 20*b* are the backs of 3 other photo cards 30. This view is the view of one player and in this view each player can see their own cards but not those of other players.

Next to card stand 20 is score card 35. This score card has provisions for scoring creativity, interest in the story, story telling ability and flow and content as characteristics of the story. In this embodiment, it is also noted that the score card 35 has scores of one through five possible for the characteristics being scored in the game. This score card 35 can be filed out by each player not telling a story and then used to keep track of cumulative scoring during the game.

Figure 2:
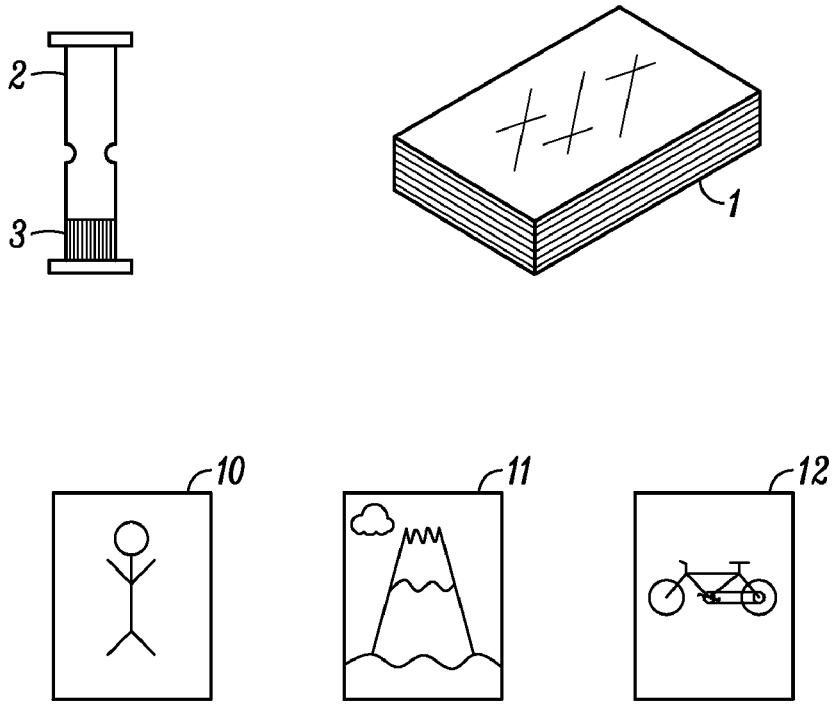
FIG. 2 is a view showing, in perspective, photo-cards laid down on a playing surface during the story telling process.

In FIG. 2, there is a partial perspective view of the game playing surface 8 during story telling. Face down deck of photo cards 1 sits next to sand timer 2. in this depiction sand timer sand 3 has completed timing and is at rest. Also photo cards 10, 11, and 12 are now face up on playing surface 8. The photo cards 10, 11 and 12 are face up so that other players can see the cards during the story telling process to aid in determination if the photo has been used in the story.

In FIG. 3 there is depicted a score card 35 designed for multi-player and multi-round play. The score card 35 shows a place for players name 36. It also shows a column for each round 37 as well as a total score line 38. A list of characteristics 40 can be placed on the card.

Figure 4:
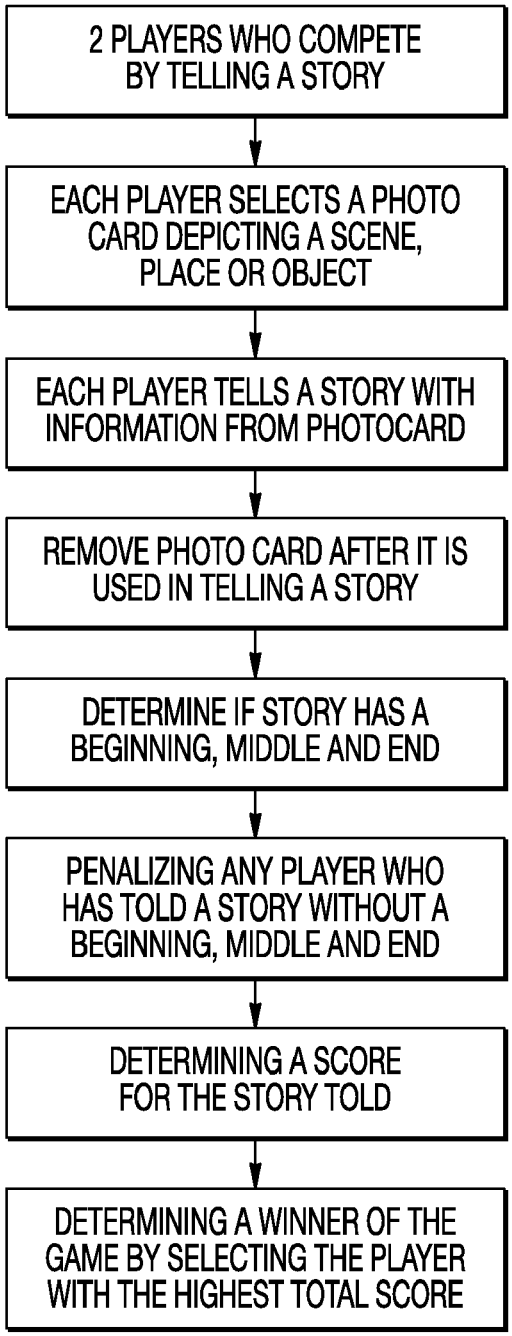
FIG 4 is a flow chart of the method of the present invention.

FIG. 4 is a flow chart showing the steps of the claimed method herein.

In an optional mode of play after completion of a predetermined number of rounds there is more than 1 player that has not gone over the time limit for telling their story; the remaining players can continue to tell stories, increasing the number of cards with each round until the last player with the most cards remains in the game. A score could be determined or not for rounds played during this optional play.

A wide variety of embodiments of this invention are possible to for one skilled in the art in view of the disclosure of the invention. The example and figures herein are not intended to be limiting on the invention and are presented as illustrative only. One skilled in the art will be able to determine what photos, the number of photos, the number of rounds as well as other variations of the game based on the disclosure herein, which variations are intended to be included in the scope of the following claims.

The invention claimed is:

1. A method for playing a game which stimulates imagination and creativity by story telling comprising:

a) having a minimum of 2 players who compete in the game by telling a story;

b) each player selecting at least one photo cards from a collection of photo cards, the collection having at least 3 photo cards per player, wherein each photo card depicts a scene, place or object;

c) each player, in turn, telling a story that includes information depicted in at least one of the photo cards selected by the player;

d) removing a photo card from the game after it has been used in telling a story;

e) using a predetermined method to determine if each told story has a beginning, middle and end;

f) penalizing any player who has been determined to have told a story that does not contain each of a beginning, middle and end;

g) determining a score for the told story; and h) determining a winner of the game by selecting the player who has the highest total score.

2. A method of playing a game according to claim 1 wherein the highest score is determined by a score selected from the group consisting of:

i) the highest characteristics score by a player or group of players;

ii) the highest total number of photo-cards used to tell a story by a player; and iii) A combination of i) and ii).

3. A method according to claim 1 wherein each time step b) is repeated the number of photo cards selected can vary from the original number selected.

4. A method according to claim 3 wherein the number of photo cards taken increases by one every second time step b) is repeated.

5. A method of playing a game according to claim 1 wherein the players repeat steps b) through g) one or more times and wherein the highest total score is the total of each players score obtained by each repetition of step g).

6. A method according to claim 1 wherein a score is awarded based on evaluation of a characteristic selected from the group consisting of: creativity, interest level, story telling, flow and content, and time either individually or in combination.

7. A method according to claim 6 wherein the characteristics are scored on a scale of one to five.

8. A method according to claim 1 wherein the telling of each story must be accomplished within a selected time.

9. A method according to claim 1 wherein each player has a predetermined time to review the photo cards selected before beginning to tell a story.

10. A method according to claim 1 wherein all the photo cards in the game, collectively, have a common theme.

11. A method according to claim 1 wherein all the photo cards in the game collectively do not have a common theme.

12. A method according to claim 1 wherein when a story is told, all the photo cards selected in the immediately prior step b) must be used in telling the story in the immediately following step c).

13. A method according to claim 1 wherein the predetermined method of step e) is a challenge by a player to a story that has just been told followed by a vote of the non-story telling players to determine if the story has a beginning, a middle and an end.

* * * * *